US012467727B2

(12) United States Patent
McNally et al.

(10) Patent No.: US 12,467,727 B2
(45) Date of Patent: Nov. 11, 2025

(54) AMMUNITION BLANK AND CORRESPONDING BOLT

(71) Applicant: Sig Sauer, Inc., Newington, NH (US)

(72) Inventors: Jacqueline K. McNally, Rochester, NH (US); Johnathon M. Hall, Beebe, AR (US); Virgil L. White, Cabot, AR (US)

(73) Assignee: Sig Sauer, Inc., Newington, NH (US)

( * ) Notice: Subject to any disclaimer, the term of this patent is extended or adjusted under 35 U.S.C. 154(b) by 0 days.

(21) Appl. No.: 18/403,178

(22) Filed: Jan. 3, 2024

(65) Prior Publication Data

US 2024/0230293 A1 Jul. 11, 2024

Related U.S. Application Data

(60) Provisional application No. 63/479,408, filed on Jan. 11, 2023.

(51) Int. Cl.

| | |
|---|---|
| ***F42B 8/04*** | (2006.01) |
| ***F41A 3/12*** | (2006.01) |
| ***F41A 3/26*** | (2006.01) |
| ***F41A 15/14*** | (2006.01) |
| ***F42B 8/02*** | (2006.01) |

(52) U.S. Cl.

CPC ..... *F42B 8/04* (2013.01); *F41A 3/26* (2013.01); *F41A 15/14* (2013.01)

(58) Field of Classification Search

CPC ..... F42B 8/04

See application file for complete search history.

(56) References Cited

U.S. PATENT DOCUMENTS 898,802 A * 9/1908 Stribeck ..... F42B 5/36 102/470
1,256,255 A * 2/1918 Porter ..... F42B 5/02 73/167
2,342,549 A * 2/1944 Le Gore ..... F42B 8/08 102/498
2,918,003 A * 12/1959 Temple ..... F42B 3/24 220/618
2,970,543 A * 2/1961 Duffield ..... F42B 5/36 102/470
3,351,019 A * 11/1967 Schaadt et al. ..... F42C 19/0815 102/470

(Continued)

FOREIGN PATENT DOCUMENTS

AT 350941 B 6/1979

OTHER PUBLICATIONS

International Search Report and Written Opinion received for PCT Application No. PCT/US2024/017042 (Nov. 15, 2024).

*Primary Examiner* — Derrick R Morgan

(74) *Attorney, Agent, or Firm* — Finch & Maloney PLLC

(57) ABSTRACT

An ammunition cartridge casing has a casing base with a proximal end surface, a casing body defining an inside volume, and a distal end portion. The casing base defines a primer pocket in communication with the inside volume of the casing body, where the primer pocket is sized and configured such that when a primer is installed in the primer pocket, a proximal face of the primer is recessed into the base at least 0.010" with respect to the end surface. Blank ammunition made with the cartridge casing is configured for use with a rifle having a bolt with a boss on the breech face that corresponds to the recessed primer.

15 Claims, 5 Drawing Sheets

(56) References Cited

U.S. PATENT DOCUMENTS 3,477,374 A * 11/1969 Barr ..... F42B 5/02 102/470
4,027,592 A * 6/1977 Hubsch ..... F42C 1/02 102/470
4,646,643 A * 3/1987 Goldenberg ..... F42B 7/12 102/464
4,862,805 A * 9/1989 Szabo ..... F42B 5/145 102/470
4,867,066 A * 9/1989 Buenemann, Jr. ..... F42B 5/307 102/466
4,958,567 A * 9/1990 Olson ..... F42B 8/02 102/447
5,048,421 A * 9/1991 Swartout ..... F42B 5/18 102/431
5,153,375 A * 10/1992 Eguizabal ..... F42B 8/04 102/447
5,460,096 A * 10/1995 Kothe ..... F42C 19/0815 102/470
5,481,978 A * 1/1996 Muller ..... F42B 5/36 102/470
5,969,288 A * 10/1999 Baud ..... F42B 5/313 102/466
6,286,432 B1 * 9/2001 Reider ..... F42C 19/083 102/470
6,612,063 B1 * 9/2003 Sigg ..... F41A 3/12 42/1.07
8,365,669 B1 * 2/2013 Saxby ..... F42B 5/045 102/470
8,850,986 B1 * 10/2014 Alalati ..... F42B 5/02 102/470
9,448,020 B1 * 9/2016 Olson ..... F41A 3/66
10,345,067 B2 * 7/2019 Brown ..... F41A 17/42
2002/0050223 A1 * 5/2002 Jackson ..... F42C 19/10 102/470
2004/0000250 A1 * 1/2004 Stratum ..... F42B 5/02 102/441
2004/0069175 A1 * 4/2004 Attarwala ..... F42B 5/36 102/438
2007/0151473 A1 * 7/2007 Brunn ..... F42B 5/02 102/444
2007/0214992 A1 * 9/2007 Dittrich ..... F42B 5/36 102/470
2010/0258023 A1 * 10/2010 Reynolds ..... F42B 5/36 102/470
2012/0324774 A1 * 12/2012 Zedrosser ..... F41A 3/12 42/2
2014/0076144 A1 * 3/2014 Gomez ..... F41A 15/12 42/25
2017/0322004 A1 11/2017 Kuchman
2019/0226818 A1 * 7/2019 Peterson ..... F41C 9/08
2020/0378707 A1 * 12/2020 Shipley ..... F41A 21/12
2021/0302116 A1 * 9/2021 Shipley ..... F41A 3/26
2023/0392909 A1 * 12/2023 Dunnam ..... F42B 7/02

* cited by examiner

AMMUNITION BLANK AND CORRESPONDING BOLT

RELATED APPLICATIONS

This application claims the benefit under 35 U.S.C. § 119(e) of U.S. Provisional Patent Application No. 63/479,408 filed on Jan. 11, 2023, the contents of which are incorporated herein by reference in its entirety.

TECHNICAL FIELD

The present disclosure relates generally to firearms and ammunition. More particularly, the present disclosure relates to blank ammunition cartridge and a corresponding bolt in the firearm to be used with the blank cartridge.

BACKGROUND

Center-fire ammunition is a type of ammunition that includes a primer centrally located in the head of the cartridge casing. When the gun is fired, a firing pin or striker contacts the primer, igniting it to initiate burning the gun powder and expel the projectile through the gun's barrel. Examples of rifle cartridges include the 5.56×45 mm NATO round, 7.62×51 mm (or .308 WIN), 6.5 mm Creedmoor, and 6.8×51 mm Each of these cartridges has a cartridge casing with a rimless design, where the base of the casing has a circumferential recess between the rim and the casing body, and where the rim has the same or nearly the same diameter as the casing base. The casing body necks down to a smaller diameter end portion with a mouth that engages and retains the projectile. In such cartridges, the primer is retained flush with the casing base.

During the firing cycle, the bolt moves forward and strips the cartridge from the top of the magazine and pushes the cartridge into the chamber. In doing so, the bolt moves forward so that lugs on the bolt are received in corresponding voids surrounding the chamber, the breech face on the bolt contacts the base of the cartridge, and the extractor snaps over the cartridge rim. After the extractor snaps over the cartridge rim, the bolt rotates to overlap the lugs, and the extractor slides under a support feature to prevent radial movement. At battery, the gun is ready to fire with the bolt rotated to a closed and locked position. Upon firing, the firing pin travels through the bolt's breech face to contact the primer, igniting the powder charge and resulting in combustion that returns the bolt rearward with the extractor engaging the cartridge rim and ejecting the spent casing through the ejection port.

SUMMARY

The present disclosure is directed to a cartridge casing for a blank ammunition cartridge, where the casing has a recessed primer pocket. For example, when a primer is installed, the proximal face of the primer is recessed into the casing base by at least 0.010" with respect to the proximal end surface of the casing. The present disclosure also relates to bolt for a firearm. In one example, the bolt has a bolt body extending along a central axis to a distal end, the bolt body defining a firing pin bore and a transverse bore, wherein the distal end includes a breech face. Lugs are interspersed circumferentially around the breech face on the distal end of the bolt body, each of the lugs extending axially and protruding radially from the bolt body. A protrusion on the breech face extends axially from the breech face by an amount corresponding to the recess distance of the primer. The present disclosure further relates to a blank rifle ammunition cartridge, a rifle equipped with a bolt having a protrusion on the breech face, and to a combination of a blank ammunition cartridge and a bolt, where the cartridge has a recessed primer and the bolt has a protrusion on the breech face that is configured to be received in the recess of the casing.

The features and advantages described herein are not all-inclusive and, in particular, many additional features and advantages will be apparent to one of ordinary skill in the art in view of the drawings, specification, and claims. Moreover, it should be noted that the language used in the specification has been selected principally for readability and instructional purposes and not to limit the scope of the disclosed subject matter.

Figure 1A:
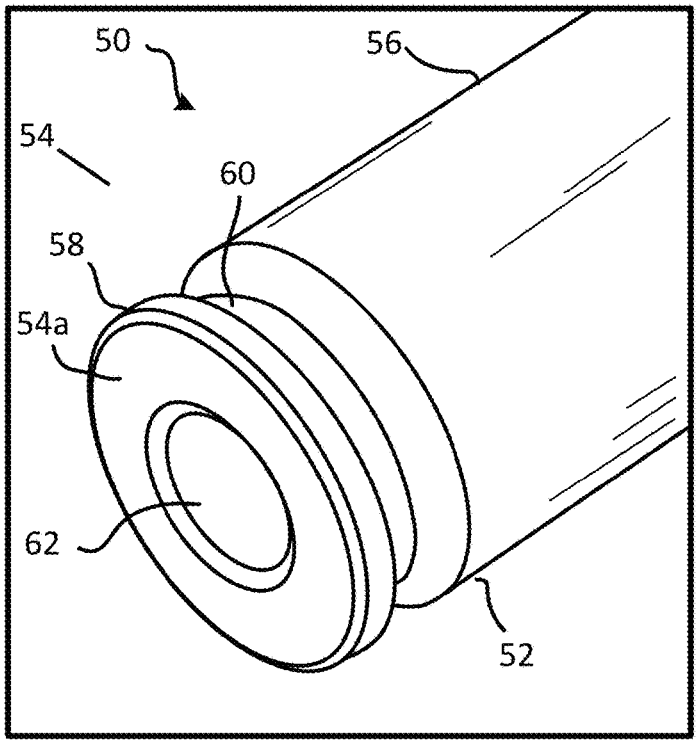
FIG. 1A (Prior Art)
FIG. 1A is a perspective view showing a base and part of the casing body of a rimless rifle cartridge, in accordance with the prior art.

The figures depict various embodiments of the present disclosure for purposes of illustration only. Numerous variations, configurations, and other embodiments will be apparent from the following detailed discussion.

DETAILED DESCRIPTION

Disclosed is a cartridge casing and a blank ammunition cartridge for use with a bolt having a breech face with a corresponding protrusion. In one example embodiment of a blank rifle cartridge, the primer is recessed into the base of the cartridge by a recess distance from 0.010" to 0.020" relative to the proximal end surface of the base. The bolt includes a boss or protrusion on the breech face that protrudes from the breech face by substantially the same axial distance (e.g., ±0.001") as the primer recess. In one example, the boss is circular except where intersected by openings for ejector pins. When the blank cartridge is used with a bolt as disclosed herein, the boss is received in the recessed primer region so that the boss and surrounding regions of the breech face contact the cartridge head. This axial overlap between the boss and the recess enables the bolt to move fully to the closed and locked position.

In use, the combination of a blank cartridge and corresponding bolt face enables the bolt to chamber the blank round and be properly closed and locked. The recessed primer and boss on the breech face provide an improved safety feature that prevents firing when the two are not used together. For example, if the user attempts to chamber a live round (having flush primer) in a gun equipped with a bolt having the boss on the breech face, the boss will result in an axial offset between the cartridge rim and the bolt. This offset prevents the extractor from snapping over the rim. In such condition, the bolt will fail to rotate fully due, for example, to interference between the extractor lug and the inside of the chamber. Accordingly, the bolt will not achieve a closed and locked condition and the round will not fire. Similarly, if the user attempts to use a blank round with recessed primer in a rifle with a traditional bolt, the round may chamber correctly, but the recessed primer will be out of reach of the firing pin when the trigger is pulled. Accordingly, the blank round will not fire.

The bolt or components on the bolt can be further modified in some embodiments. For example, the extractor can have a lug that extends radially to a further extent than on traditional extractors. Also, the extractor hook can be moved rearward by approximately 0.010" to improve alignment with the cartridge rim, such as when a projectile cartridge is used with the bolt of the present disclosure. When used together or individually, these optional additional features can enhance performance of the safety benefit associated with the recessed primer and boss on the breech face of the bolt.

As discussed in more detail below, a bolt having a boss on the breech face and/or a blank round with a recessed primer advantageously provides improved safety in the event that the user attempts to use a blank with a live-fire rifle or a live-fire round with a rifle equipped to fire blanks.

Overview

Blank ammunition cartridges have been used for training and in starter pistols. Known blank cartridges are constructed in the same way as a live-fire cartridge except for having a crimped casing nose portion instead of a projectile. That is, the ammunition casing houses a primer in the base and powder is retained in the casing body. When the gun is fired, the firing pin strikes the primer and ignites the propellant in the casing, just as occurs in projectile cartridges. However, since a blank cartridge does not have a projectile, only the blast from the burning powder travels through the barrel and is capped by a muzzle device to maintain pressure for weapon cycling.

To prevent inadvertent injury and death, known use of blank ammunition relies on strict protocol to ensure that projectile ammunition is not loaded into the magazine or rifle when blank ammunition is supposed to be used. Despite these protocols, projectile ammunition sometimes is used during training exercises and results in death or injury to participants. Therefore, a need exists for a mechanism to improve safety when using blank ammunition, such as during training exercises.

The present disclosure addresses this need and others by providing a blank rifle cartridge with a recessed primer. The blank cartridge can be used with a corresponding rifle bolt that has a protrusion on the breech face. When used together, the blank cartridge and modified bolt enable the user to fire the blank cartridge. However, if one attempts to use a projectile cartridge in the firearm with the modified bolt, or if the user attempts to use a blank cartridge with a traditional bolt, the cartridge will not fire. Thus, safety is improved for training exercises and other situations where blank ammunition is used.

A cartridge and bolt disclosed herein are discussed in the context of an autoloading rifle with a rotating bolt, such as a rifle based on the AR-10 platform. The ammunition and bolt disclosed herein is particularly useful in autoloading rifles chambered for a 5.56×45 mm NATO round, 7.62×51 mm (or .308 WIN), 6.5 mm Creedmoor, or 6.8×51 mm, to name a few examples. The concepts disclosed herein are not limited to rifle ammunition, to a particular caliber, or to use with rifles using a rotating bolt, but can be applied to other types of ammunition and firearms. In addition to rifles mentioned above, concepts disclosed herein can be used with any autoloading firearm, including belt-fed machine guns, pistols, and short-barreled rifles, to name a few examples. Numerous variations and embodiments will be apparent in light of the present disclosure.

Example Embodiments

FIG. 1A illustrates a rear perspective view of a firearm cartridge 50 of the prior art and shows the base 54 and part of a cartridge casing 52. In this example, the casing 52 is configured as a rimless casing that defines an extraction groove 60 between the rim 58 and casing body 56. A primer 62 is retained in a central primer opening and is flush or substantially flush with (e.g., 0.005 inch or less) the base 54 so as to prevent igniting the primer 62 if the cartridge is dropped.

Figure 1B:
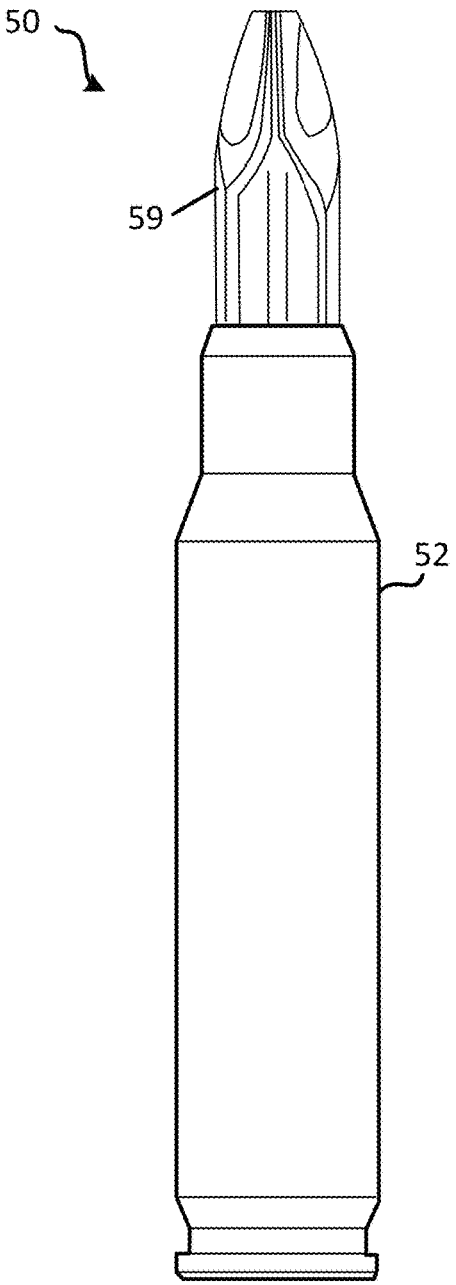
FIG. 1B (Prior Art)
FIG. 1B is a side view of a blank rifle cartridge, in accordance with the prior art.

FIG. 1B is a side view of a blank cartridge 50 of the prior art. In lieu of a projectile, the brass of the casing 52 is crimped to form a tip 59 that enables the cartridge 50 to feed properly into a chamber.

Figure 2A:
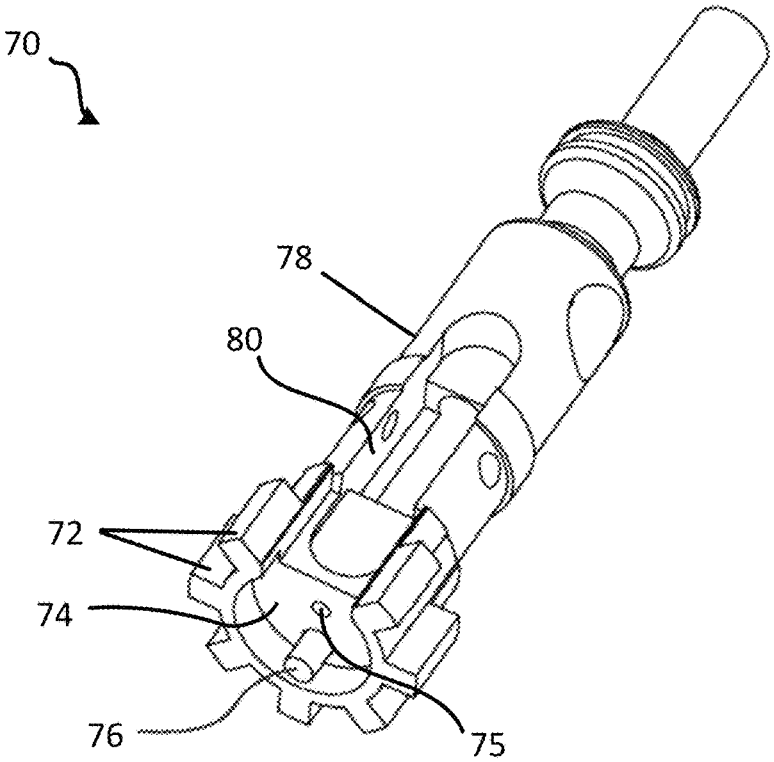
FIG. 2A (Prior Art)
FIG. 2A is a top and front perspective view showing a bolt for an AR-15-type rifle with the extractor omitted, in accordance with the prior art.

FIG. 2A illustrates a front perspective view of a bolt 70 for a rifle based on the AR-15 platform, in accordance with the prior art. The bolt 70 includes lugs 72 at the distal end that surround and extend axially beyond a breech face 74. Note that the breech face 74 is planar and defines a centrally located opening 75 for the firing pin. An ejector pin 76 protrudes through the breech face 74. The bolt body 78 defines a slot 80 for an extractor 82 (shown in FIG. 2B).

Figure 2B:
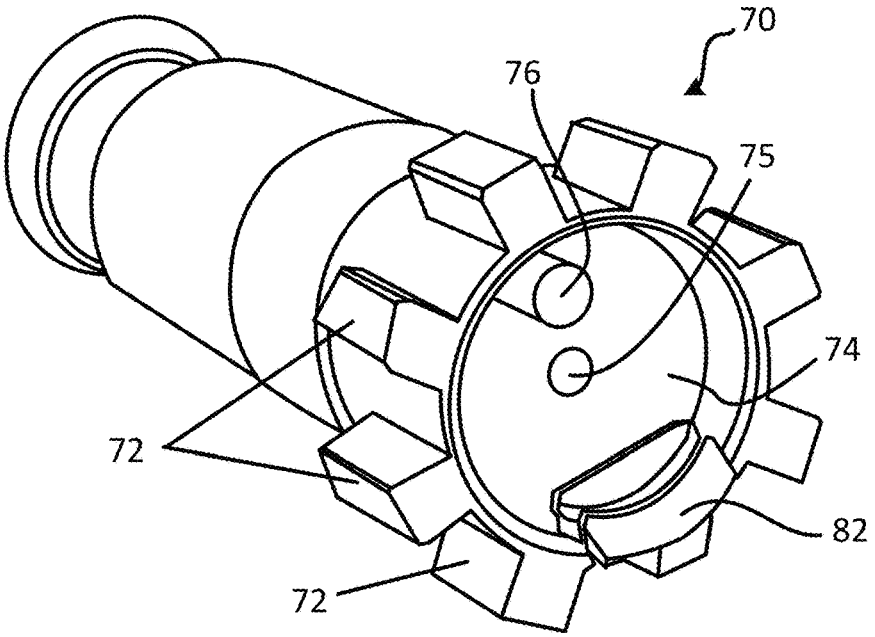
FIG. 2B (Prior Art)
FIG. 2B is a front perspective view showing the front end of a bolt for an AR-15-type rifle, in accordance with the prior art.

FIG. 2B is a front perspective view of a distal end of a bolt 70 in accordance with the prior art. Similar to the embodiment shown in FIG. 2A, the bolt 70 has a planar breech face 74 that defines a centrally located opening 75 for the firing pin. A single ejector pin 76 protrudes through the breech face 74. Lugs 72 extend axially and protrude radially, where the lugs 72 are arranged around the outside of the breech face 74. An extractor 82 occupies the position of one lug. The extractor 82 is configured to overlap the cartridge rim 58 and seat in the extraction groove, enabling the extractor 82 to remove a spent cartridge casing after firing. The extractor 82 is spring biased radially inward.

Figure 3A:
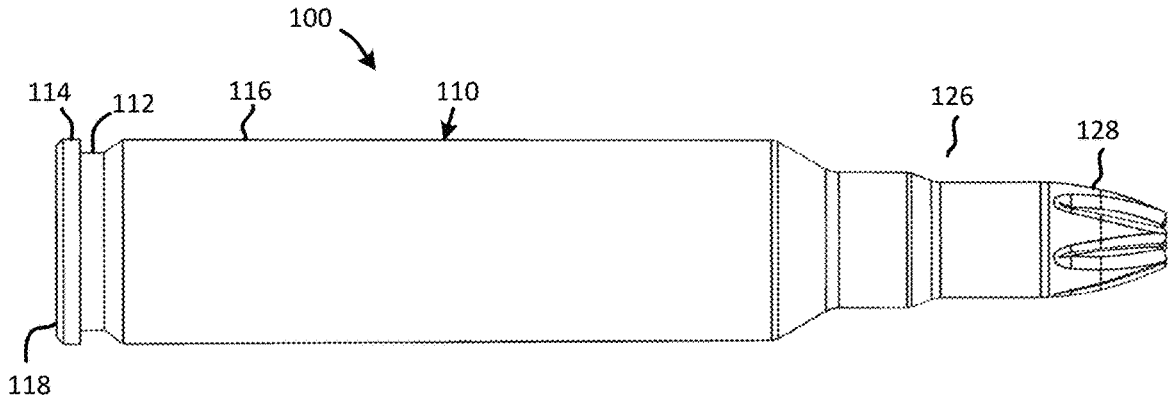
FIG. 3A illustrates a side view of blank rifle cartridge, in accordance with an embodiment of the present disclosure.
Figure 3B:
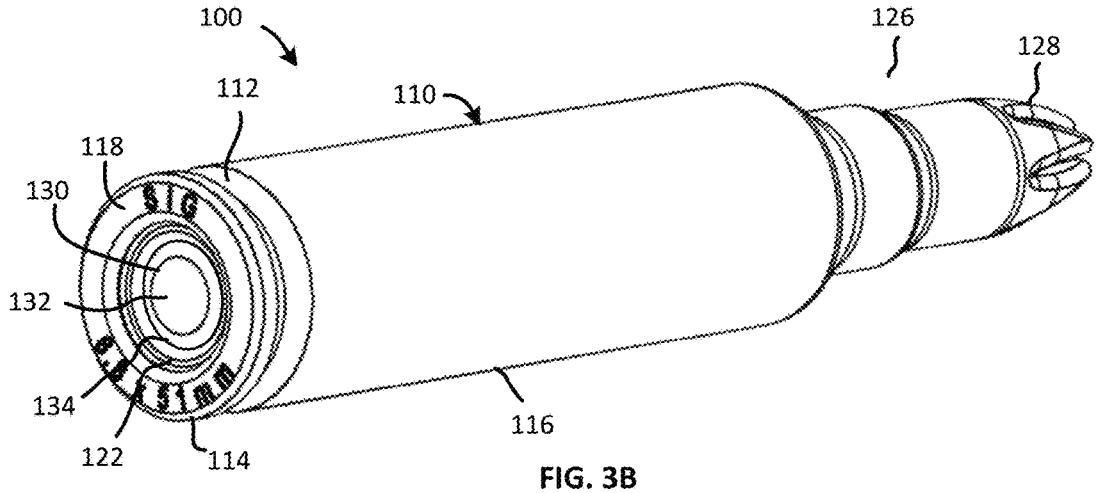
FIG. 3B illustrates a rear perspective view of the blank rifle cartridge of FIG. 3A.
Figure 3C:
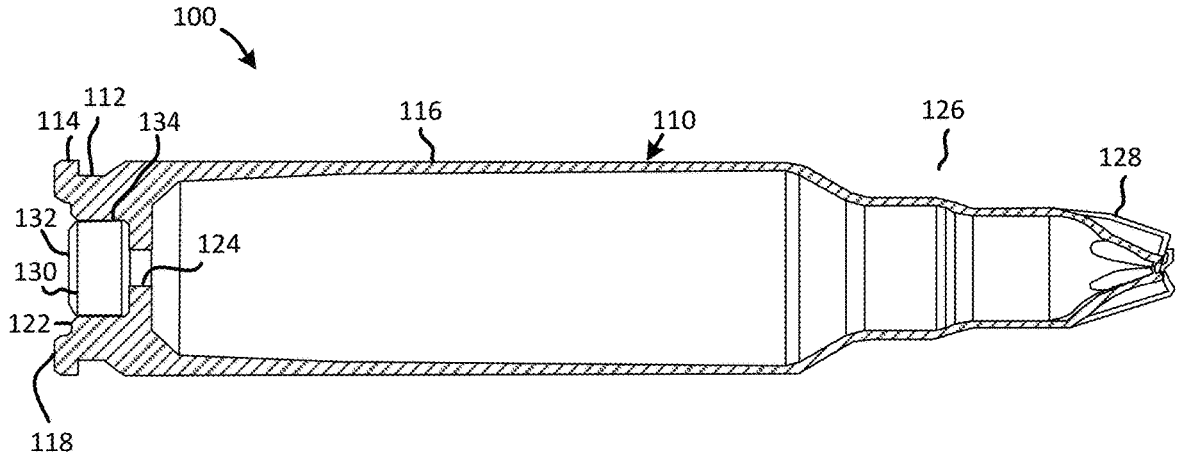
FIG. 3C illustrates a side cross-sectional view of the cartridge of FIG. 3A.

Referring now to FIGS. 3A-3C, a blank cartridge 100 is illustrated in a side view, a rear perspective view, and a side cross-sectional view, respectively, in accordance with an embodiment of the present disclosure. The cartridge 100 includes a "rimless" casing 110 with a base 120 that defines an extraction groove 112 between the rim 114 and casing body 116. A primer 130 is retained in a primer pocket 134 defined in the base 120 and is recessed with respect to the proximal end surface 118. The primer pocket 134 communicates with an inside of the casing body 116 via a flash opening 124. A distal end portion 126 of the casing 110 has a reduced diameter that terminates with a crimped end 128. In its completed state, a quantity of propellant is contained in the casing body 116, such as nitrocellulose "smokeless" powder or other acceptable explosive composition.

The primer pocket 134 is configured and arranged so that when a primer 120 is installed, the exposed primer face 132 is recessed at least 0.020" with respect to the proximal end surface 118 of the base 120. For example, the edge of the primer pocket 134 is recessed with respect to the proximal end surface 118 by at least 0.020", including 0.022", 0.024", 0.026", 0.028", 0.030" and ranges and sub-ranges between these values. An annular region 122 of the base 120 is radially between the primer pocket 134 and the proximal end surface 118 and circles the primer pocket 134. The annular region 122 is also recessed with respect to the proximal end surface 118. In some embodiments, the annular region 122 is planar and the primer face 132 and annular region 122 are substantially co-planar (e.g., within ±0.002"). In other embodiments, the annular region 122 steps, slopes, or tapers between the proximal end surface 118 and the primer pocket 134.

Figure 4:
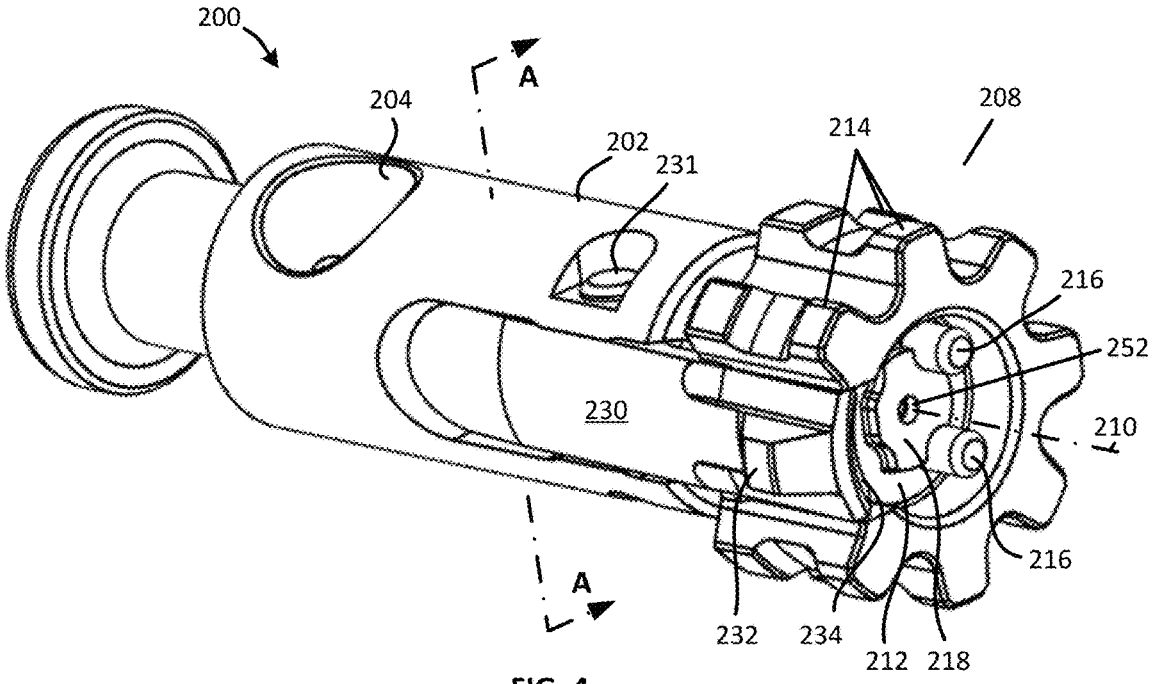
FIG. 4 illustrates a front perspective view of a bolt with a boss on the breech face, in accordance with an embodiment of the present disclosure.
Figure 5:
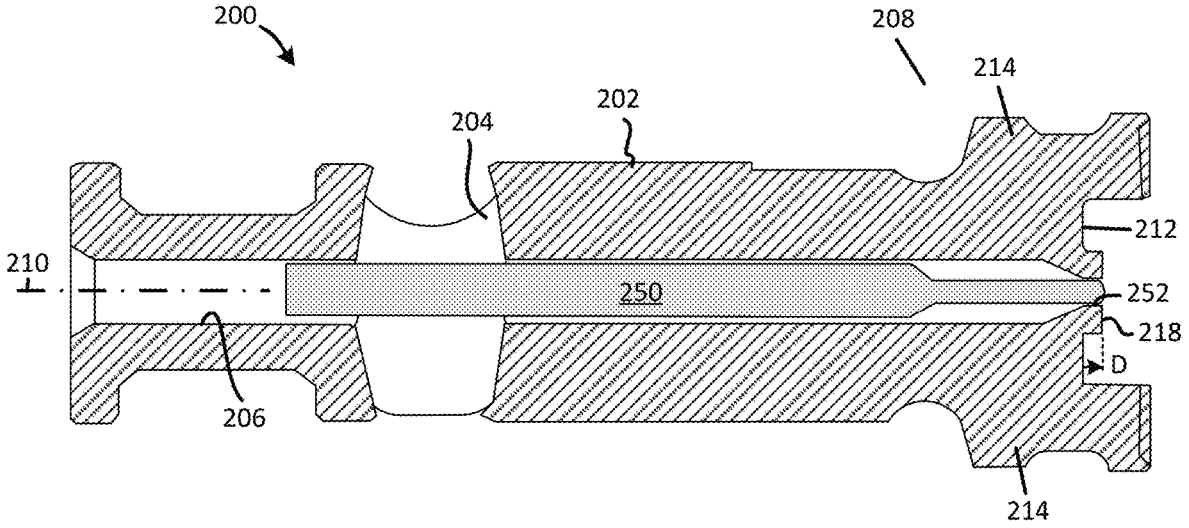
FIG. 5 illustrates a cross-sectional view of a bolt and firing pin, such as viewed along line A-A of FIG. 4, in accordance with an embodiment of the present disclosure.

FIG. 4 illustrates a front perspective view of a bolt 200 for a rifle, in accordance with an embodiment of the present disclosure. FIG. 5 illustrates a longitudinal section of a bolt 200 and firing pin as viewed along line A-A of FIG. 4, in accordance with an embodiment of the present disclosure. FIGS. 4 and 5 are discussed concurrently below. Note that some components or structures of the bolt 200 may be omitted for purposes of drawing simplicity, but the concepts disclosed herein are not limited to the bolt 200 as illustrated.

In this example, the bolt 200 is configured as a rotating bolt for use in a semiautomatic or automatic rifle based on the AR-10 platform. The bolt 200 includes a bolt body 202 that defines a transverse bore 204 for a cam pin (not shown). The bolt 200 also defines a firing pin bore 206 extending along a central axis 210 and penetrating the breech face 212. As shown in FIG. 5, a firing pin 250 is movably retained in the firing pin bore 206. A distal end portion 208 of the bolt 200 has a plurality of lugs 214, each of which extends axially and protrudes radially from the bolt 200. The lugs 214 are positioned to encircle the breech face 212, which is recessed axially with respect to the lugs 214. One or more ejector pins 216 (two ejector pins 216 are shown) extend through the breech face 212. Note that ejector pins 216 are not shown in FIG. 5. An extractor 230 is attached to the bolt body 202 with a pin 231 and extends axially along the bolt body 202. The extractor 230 includes an extractor lug 232 and a hook 234.

A protrusion 218 extends axially from the breech face 212 and defines a firing pin opening 252. The protrusion 218 has an axial dimension D that is equal to the recess depth of the primer face 132, within acceptable head spacing tolerances. For example, the protrusion 218 has an axial dimension D from 0.012" to 0.016", or about 0.014". In one embodiment, when the bolt 200 engages a cartridge 100 in battery, the breech face 212 contacts the proximal end surface of the casing, and the protrusion 218 contacts the annular region 122 and/or primer face 132. In some embodiments, the breech face 212 or the protrusion 218 may be spaced from the respective ammunition surface within acceptable tolerances for firing blank ammunition discussed above.

The protrusion 218 has a shape that can be received within the annular region 122 of the cartridge casing 52. For example, except where it is intersected by ejector pin(s) 216, the protrusion 218 has a circular shape, a plus or cruciform shape, a rectangular shape with rounded ends, a quatrefoil shape, a hexagon shape, or other suitable shape, including combinations and variations of these examples. In some embodiments, the protrusion 218 has a solid interior region except for the firing pin opening 252.

Figure 6:
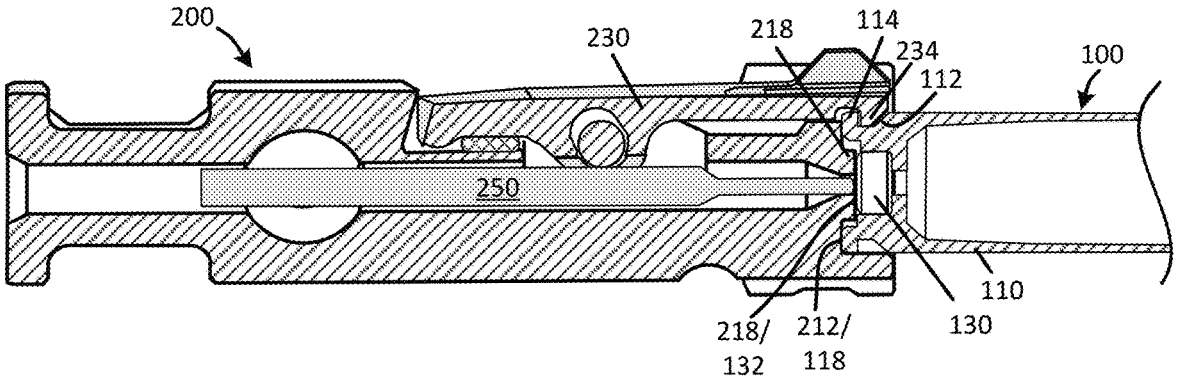
FIG. 6 illustrates a side and cross-sectional view of a bolt assembly and part of a blank cartridge, in accordance with some embodiments of the present disclosure.

FIG. 6 illustrates a side cross-sectional view of a bolt 200 and blank cartridge 100, in accordance with an embodiment of the present disclosure. The cartridge 100 has a recessed primer 130 and the bolt 200 has a protrusion 218 of corresponding geometry on the breech face 212. In this example, the bolt 200 and cartridge 100 are shown in a battery position with the protrusion 218 received in the recess. The protrusion 218 contacts the primer face 132 and the breech face 212 contacts the proximal end surface 118 of the casing 110. The hook 234 on the extractor 230 has snapped over the rim 114 and occupies the extraction groove 112. In this battery condition, the extractor lug 232 is able to clear the inside of the chamber when the bolt 200 rotates to the locked position. Upon firing, the firing pin 250 will strike the primer 130 to ignite the propellant in the cartridge 50.

Figure 7:
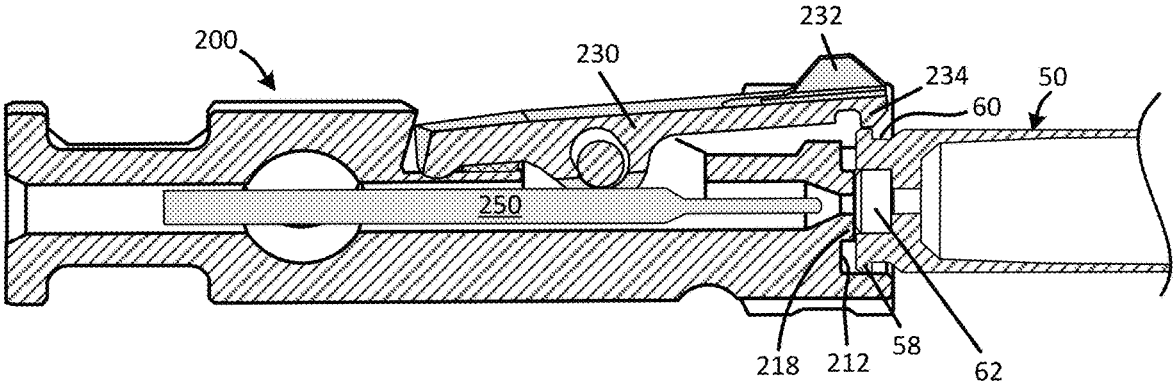
FIG. 7 illustrates a side and cross-sectional view of the bolt assembly of FIG. 6 in use with a traditional cartridge.

FIG. 7 illustrates a side cross-sectional view of the bolt 200 of FIG. 6 in use with a conventional cartridge 50 having a primer 62 substantially flush with the base 54. In this example, the protrusion 218 on the breech face 212 contacts the primer 62, which is not recessed beyond the amount necessary to prevent primer ignition if the cartridge is dropped. As a result, the base 54 of the cartridge 50 is axially spaced from the breech face 212. In this position, the hook 234 on the extractor 230 is not aligned with the extraction groove 60 and the hook 234 cannot snap over the rim 58. Therefore, the hook 234 remains in contact with the rim 58 and radially deflects the extractor lug 232 to a position where it contacts the inside of the chamber, thereby preventing the bolt 200 from rotating to the locked position and resulting in an out-of-battery failure to fire.

Figure 8:
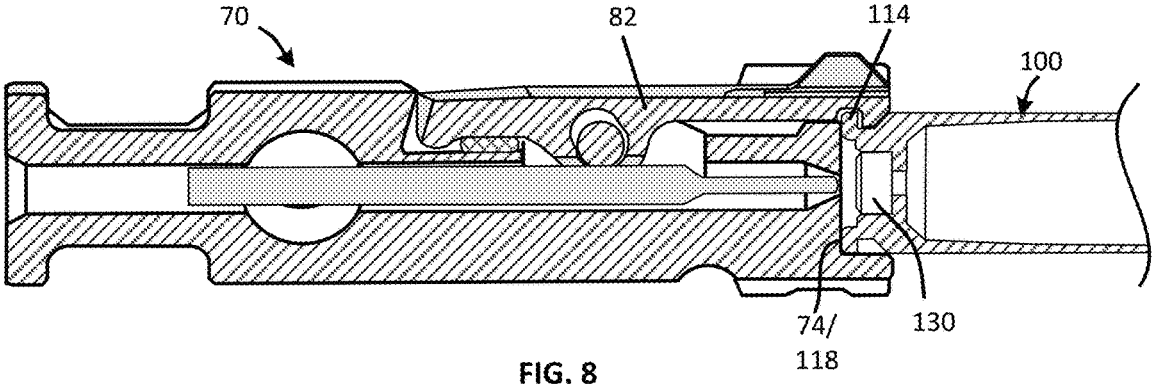
FIG. 8 illustrates a side and cross-sectional view of a traditional bolt assembly in use with a blank cartridge of the present disclosure.

FIG. 8 illustrates a conventional bolt 70 in use with a blank cartridge 100 of the present disclosure, in accordance with one embodiment. In this example, the bolt 70 and cartridge 100 are in a battery position with the proximal end surface 118 of the cartridge 100 in contact with the breech face 74. The bolt 70 has a planar breech face 74 with no protrusion 218. Even though the extractor 82 can snap over the rim 114 and the bolt 70 can rotate to the locked position, the primer 130, which is recessed into the base 120 of the cartridge 100, is out of reach of the firing pin 250. Thus, the blank cartridge 100 will not fire due to the axial offset between the recessed primer 130 and the breech face 74 of the bolt 70.

Further Example Embodiments

The following examples pertain to further embodiments, from which numerous permutations and configurations will be apparent.

Example 1 is a blank ammunition cartridge casing having a casing base with a proximal end surface, a casing body defining an inside volume, and a distal end portion. The casing base defines a primer pocket in communication with the inside volume of the casing body, where the primer pocket is sized and configured such that when a primer is installed in the primer pocket, a proximal face of the primer is recessed into the base at least 0.010" with respect to the end surface.

Example 2 includes the cartridge casing of Example 1 and further includes a primer housed in the casing base.

Example 3 includes the cartridge casing of any one of Examples 1 or 2, where when the primer is installed in the primer pocket, the proximal face of the primer is recessed into the casing base at least 0.012".

Example 4 includes the cartridge casing of any one of Examples 1-2, where when the primer is installed in the primer pocket, the proximal face of the primer is recessed into the base at least 0.014".

Example 5 includes the cartridge casing of any one of Examples 1-4, where the distal end portion of the casing has a smaller diameter than a diameter of the casing body and the casing further defines a taper between the casing body and the distal end portion.

Example 6 includes the cartridge casing of any one of Examples 1-5 and further includes a propellant contained within the casing body.

Example 7 includes the cartridge casing of any one of Examples 1-6, where the base defines an annular region between the primer pocket and the proximal end surface, the annular region recessed axially into the casing base.

Example 8 includes the cartridge casing of Example 7, where the annular region is substantially flush with the proximal face of the primer when the primer is installed in the primer pocket.

Example 9 includes the cartridge casing of any one of Examples 1-8, where the cartridge is configured for use with a rifle chambered in 7.62×51 mm, 6.8×51 mm, 6.5 Creedmoor, or 5.56×45 mm NATO.

Example 10 is a bolt for a firearm, the bolt having a bolt body extending along a central axis to a distal end, the bolt body defining a firing pin bore and a transverse bore, wherein the distal end includes a breech face. Lugs are interspersed circumferentially around the breech face on the distal end of the bolt body, each of the lugs extending axially and protruding radially from the bolt body. A protrusion on the breech face extends axially from the breech face by at least 0.010", where the firing pin bore extends through the protrusion.

Example 11 includes the bolt of Example 10, where the protrusion extends axially by at least 0.012" from the breech face.

Example 12 includes the bolt of Example 10, where the protrusion extends axially by at least 0.014" from the breech face.

Example 13 includes the bolt of any one of Examples 10-12 and further includes at least one ejector pin biased to extend through an ejector pin opening in the breech face.

Example 14 includes the bolt of Example 13, where the at least one ejector pin opening intersects the protrusion.

Example 15 includes the bolt of any one of Examples 10-14 and further includes an extractor pivotably attached to the bolt body and movable between a resting state and a deflected state, the extractor including an extractor hook extending radially inward and an extractor lug extending radially outward.

Example 16 includes the bolt of Example 15, wherein in the deflected state the extractor lug extends radially outward from the central axis a distance that is greater than a radial dimension from the central axis of neighboring lugs.

Example 17 includes the bolt of any one of Examples 10-16, where the bolt is adapted for use in an autoloading firearm.

Example 18 is a firearm including the bolt of any one of Examples 10-17.

Example 19 is the firearm of Example 18 configured as an autoloading firearm.

Example 20 is the firearm of Example 19, where the autoloading firearm is based on the AR-10 platform.

Example 21 is the firearm of any one of Examples 18-20, where the firearm is chambered in 7.62×51 mm, 6.8×51 mm, 6.5 Creedmoor, or 5.56×45 mm NATO.

Example 22 is a combination of a blank ammunition cartridge and a bolt for an autoloading firearm. The blank ammunition cartridge has a cartridge casing having a casing base with a proximal end surface, a casing body defining an inside volume, and a distal end portion. The casing base defines a primer pocket in communication with the inside volume of the casing body. A primer is installed in the primer pocket, where a proximal face of the primer is recessed into the base by a recess distance of at least 0.010" with respect to the end surface of the casing base. A propellant is within the casing body. The bolt has a bolt body extending along a central axis to a distal end with a breech face. The bolt body defines a firing pin bore and a transverse bore. Lugs are interspersed circumferentially around the breech face on the distal end of the bolt body, where each lug extends axially and protrudes radially from the bolt body. A protrusion on the breech face extends axially from the breech face by the recess distance ±0.001", wherein the firing pin bore extends through the protrusion.

Example 23 includes the combination of Example 22, where the recess distance is at least 0.012".

Example 24 includes the combination of Example 22, where the recess distance is at least 0.014".

Example 25 includes the combination of any one of Examples 22-24, where the distal end portion of the casing has a smaller diameter than a diameter of the casing body and the casing further defines a taper between the casing body and the distal end portion.

Example 26 includes the combination of any one of Examples 22-25, where the cartridge base defines an annular region between the primer and the proximal end surface, the annular region recessed axially into the casing base.

Example 27 includes the combination of Example 26, where the annular region is substantially flush with the proximal face of the primer.

Example 28 includes the combination of any one of Examples 22-27, where the cartridge is configured for use with a rifle chambered in 7.62×51 mm, 6.8×51 mm, 6.5 Creedmoor, or 5.56×45 mm NATO.

Example 29 includes the combination of any one of Examples 22-28, where the bolt comprises at least one ejector pin biased to extend through an ejector pin opening in the breech face.

Example 30 includes the combination of Example 29, where the at least one ejector pin opening intersects the protrusion.

Example 31 includes the combination of any one of Examples 22-30, where the bolt incudes an extractor pivotably attached to the bolt body and is movable between a resting state and a deflected state, the extractor including an extractor hook extending radially inward and an extractor lug extending radially outward.

Example 32 includes the combination of Example 31, where in the deflected state the extractor lug extends radially outward from the central axis a distance that is greater than a radial dimension from the central axis of neighboring lugs.

Example 33 includes the combination of any one of Examples 22-32, where the bolt is adapted for use in an autoloading firearm.

The foregoing description of example embodiments has been presented for the purposes of illustration and description. It is not intended to be exhaustive or to limit the present disclosure to the precise forms disclosed. Many modifications and variations are possible in light of this disclosure. It is intended that the scope of the present disclosure be limited not by this detailed description, but rather by the claims appended hereto. Future-filed applications claiming priority to this application may claim the disclosed subject matter in a different manner and generally may include any set of one or more limitations as variously disclosed or otherwise demonstrated herein.

The invention claimed is:

1. A blank ammunition cartridge casing comprising:

a casing base with a proximal end surface;

a casing body defining an inside volume; and a distal end portion, wherein the casing base defines a primer pocket in communication with the inside volume of the casing body;

wherein the base defines an annular region extending radially outward from the primer pocket, the annular region recessed axially with respect to the proximal end surface by at least 0.014", and wherein the primer pocket is sized such that when a primer is installed in the primer pocket that a proximal face of the primer is flush with or recessed axially with respect to a proximal surface of the annular region.

2. The blank ammunition cartridge of claim 1, further comprising the primer housed in the casing base.

3. The blank ammunition cartridge of claim 1, wherein the distal end portion of the casing has a smaller diameter than a diameter of the casing body and the casing further defines a taper between the casing body and the distal end portion.

4. The blank ammunition cartridge of claim 1, wherein the cartridge is configured for use with a rifle chambered in 7.62×51 mm, 6.8×51 mm, 6.5 Creedmoor, or 5.56×45 mm NATO.

5. A bolt for a firearm, the bolt comprising:

a bolt body extending along a central axis to a distal end, the bolt body defining a firing pin bore and a transverse bore, wherein the distal end includes a breech face sized and configured to engage a cartridge head;

lugs interspersed circumferentially around the breech face on the distal end of the bolt body, each of the lugs extending axially and protruding radially from the bolt body; and a protrusion on the breech face, the protrusion extending axially from the breech face by at least 0.014", wherein the protrusion is configured to be at least partially inserted in or received in the cartridge head, and wherein the firing pin bore extends through a distal surface of the protrusion.

6. The bolt of claim 5, wherein the protrusion extends axially by at least 0.020" from the breech face.

7. The bolt of claim 5, wherein the breech face defines an ejector pin opening and the bolt further comprising an ejector pin biased to extend through the ejector pin opening.

8. The bolt of claim 7, wherein the ejector pin opening intersects the protrusion.

9. The bolt of claim 5, further comprising an extractor pivotably attached to the bolt body and movable between a resting state and a deflected state, the extractor including an extractor hook extending radially inward and an extractor lug extending radially outward, wherein in the deflected state the extractor lug extends radially outward from the central axis a distance that is greater than a radial dimension from the central axis of neighboring lugs.

10. A firearm including the bolt of claim 5.

11. In combination, a blank ammunition cartridge and a bolt for an autoloading firearm, the combination comprising:

a blank ammunition cartridge comprising:

cartridge casing having a casing base with a proximal end surface, a casing body defining an inside volume, and a distal end portion, wherein the casing base defines a primer pocket in communication with the inside volume of the casing body, wherein the end surface defines an annular region extending radially outward from the primer pocket and recessed axially into the casing base by a recess distance of at least 0.014";

a primer installed in the primer pocket, wherein a proximal face of the primer is flush with or recessed with respect to a proximal surface of the annular region; and a propellant within the casing body; and a bolt comprising:

a bolt body extending along a central axis to a distal end, the bolt body defining a firing pin bore and a transverse bore, wherein the distal end includes a breech face sized and configured to engage the casing base;

lugs interspersed circumferentially around the breech face on the distal end of the bolt body, each of the lugs extending axially and protruding radially from the bolt body; and a boss on the breech face, the boss extending axially from the breech face by the recess distance +0.001", wherein the firing pin bore extends through a distal surface of the boss.

12. The combination of claim 11, wherein the recess distance is at least 0.020".

13. The combination of claim 11, wherein the distal end portion of the casing has a smaller diameter than a diameter of the casing body and the casing further defines a taper between the casing body and the distal end portion.

14. The combination of claim 11, wherein the breech face defines an ejector pin opening that intersects the boss, and the bolt comprises at least one ejector pin biased to extend through the ejector pin opening.

15. The combination of claim 11, further comprising an extractor pivotably attached to the bolt body and movable between a resting state and a deflected state, the extractor including an extractor hook extending radially inward and an extractor lug extending radially outward, wherein in the deflected state the extractor lug extends radially outward from the central axis a distance that is greater than a radial dimension from the central axis to a radially outside face of one or more neighboring lugs.

* * * * *